US009795848B1

(12) United States Patent
Fairchild

(10) Patent No.: US 9,795,848 B1
(45) Date of Patent: Oct. 24, 2017

(54) DYE-SUBLIMATED GOLF FLAG

(71) Applicant: Steven Louis Fairchild, Marion, IA (US)

(72) Inventor: Steven Louis Fairchild, Marion, IA (US)

( * ) Notice: Subject to any disclaimer, the term of this patent is extended or adjusted under 35 U.S.C. 154(b) by 174 days.

(21) Appl. No.: 14/805,153

(22) Filed: Jul. 21, 2015

(51) Int. Cl.

| | |
|---|---|
| ***G09F 17/00*** | (2006.01) |
| ***A63B 57/00*** | (2015.01) |
| ***B41J 2/325*** | (2006.01) |
| ***D06P 5/28*** | (2006.01) |

(52) U.S. Cl.
CPC ..... *A63B 57/00* (2013.01); *B41J 2/325* (2013.01); *D06P 5/004* (2013.01); *G09F 17/00* (2013.01); *G09F 2017/0033* (2013.01)

(58) Field of Classification Search
CPC ..... G09F 17/00; G09F 17/0091; G09F 2017/0033; D06P 5/004; D06P 5/005; D06P 5/006; D06P 5/00; A63B 57/357; A63B 57/40
USPC ..... 116/173, 174, 175
See application file for complete search history.

(56) References Cited

U.S. PATENT DOCUMENTS

| | | | | |
|---|---|---|---|---|
| 2,632,269 | A * | 3/1953 | Sanders | G09F 21/04 116/173 |
| 3,706,297 | A * | 12/1972 | Voorhees | G09F 17/00 116/174 |
| 3,732,845 | A * | 5/1973 | Istre | G09F 17/00 116/173 |
| 4,576,610 | A | 3/1986 | Donenfeld | |
| 5,207,174 | A * | 5/1993 | Fabbrini | B43K 29/00 116/173 |
| 5,962,368 | A | 10/1999 | Poole | |
| 6,090,749 | A | 7/2000 | Kowalski | |
| 6,107,245 | A | 8/2000 | Kuga et al. | |
| 6,467,898 | B2 | 10/2002 | Codos et al. | |
| 6,536,893 | B2 | 3/2003 | Kowalski | |
| 6,726,317 | B2 | 4/2004 | Codos | |
| 7,414,010 | B2 * | 8/2008 | Burrows | B41M 5/035 503/227 |
| 7,498,065 | B2 | 3/2009 | Siegel | |
| 8,017,180 | B2 | 9/2011 | Macedo | |

(Continued)

FOREIGN PATENT DOCUMENTS

| | | | |
|---|---|---|---|
| CA | 2442429 | A1 | 10/2002 |
| CN | 2781502 | Y | 5/2006 |

(Continued)

OTHER PUBLICATIONS

"Custom Flags," Advertising Ideas, www.inflate.net, p. 1-6, Jul. 20, 2015.

(Continued)

*Primary Examiner* — R. A. Smith
(74) *Attorney, Agent, or Firm* — Shook, Hardy & Bacon L.L.P.

(57) ABSTRACT

A double-sided sublimated article and method for producing the same is provided. The article may be a golf flag and is made up of a single piece of a three layer twill weaving fabric. The fabric is woven such that horizontal threads are visible and a vertical thread is not visible. Each side of the article may be simultaneously sublimated with an ultraviolet resistant ink to produce a double-sided sublimated article having images on each side in a correct orientation.

19 Claims, 5 Drawing Sheets

(56) References Cited

U.S. PATENT DOCUMENTS

| | | | | |
|---|---|---|---|---|
| 8,337,007 | B2 | 12/2012 | Wang et al. | |
| 8,475,905 | B2 | 7/2013 | Abrams | |
| 8,485,657 | B2 | 7/2013 | Pinto et al. | |
| 9,180,729 | B2 * | 11/2015 | Abrams | B32B 5/026 |
| 2005/0183215 | A1 * | 8/2005 | Ford | D03D 15/00 8/536 |
| 2009/0035461 | A1 | 2/2009 | Grier et al. | |
| 2011/0220005 | A1 * | 9/2011 | Comfort | G09F 17/00 116/173 |
| 2012/0040281 | A1 | 2/2012 | Wang et al. | |
| 2014/0356589 | A1 | 12/2014 | Lamm | |
| 2015/0029288 | A1 * | 1/2015 | Will | B41M 5/0358 347/213 |

FOREIGN PATENT DOCUMENTS

| | | | | |
|---|---|---|---|---|
| CN | 102248818 | A | 11/2011 | |
| DE | 2629085 | A1 * | 1/1978 | G09F 17/00 |
| FR | 2357152 | A7 * | 1/1978 | G09F 17/00 |
| JP | 10060781 | A * | 3/1998 | G09F 17/00 |
| WO | 9738863 | A1 | 10/1997 | |

OTHER PUBLICATIONS

"Flags," TVF—Top Value Fabrics, www.tvfmedia.com, p. 1-2, 2015.

"3D UV Printer—Small UV Printer, 3D Flatbed Printer," Skyjet, www.skyair-ship.com, p. 1-5, Jun. 10, 2014.

"Attract Attention with Outdoor Banner Flags—Teardrop Outdoor Banner Flag," Monster Displays, http://blog.monsterdisplays.com/outdoor-display-ideas-make-event-success/, p. 1-5, 2015.

* cited by examiner

DYE-SUBLIMATED GOLF FLAG

SUMMARY

A high level overview of various aspects of the invention is provided here for that reason, to provide an overview of the disclosure and to introduce a selection of concepts that are further described below in the detailed-description section below. This summary is not intended to identify key features or essential features of the claimed subject matter, nor is it intended to be used as an aid in isolation to determine the scope of the claimed subject matter.

In brief, and at a high level, this disclosure describes, among other things, a dye-sublimated golf flag. A double-sided dye-sublimated golf flag, printed with ultraviolet resistant ink, is created by simultaneously sublimating both sides of the golf flag. The golf flag comprises a single piece of fabric that is a three layer woven fabric including threads in a horizontal direction and threads in a vertical direction. The threads in the horizontal direction are woven such that half of the threads are visible on one side of the flag and half of the threads are visible on the other side of the flag. The threads in the vertical direction are not visible and act as a light and ink barrier between each side of the flag.

BRIEF DESCRIPTION OF THE DRAWINGS

Illustrative embodiments of the present invention are described in detail below with reference to the attached drawings figures, and wherein.

DETAILED DESCRIPTION

Figure 1:
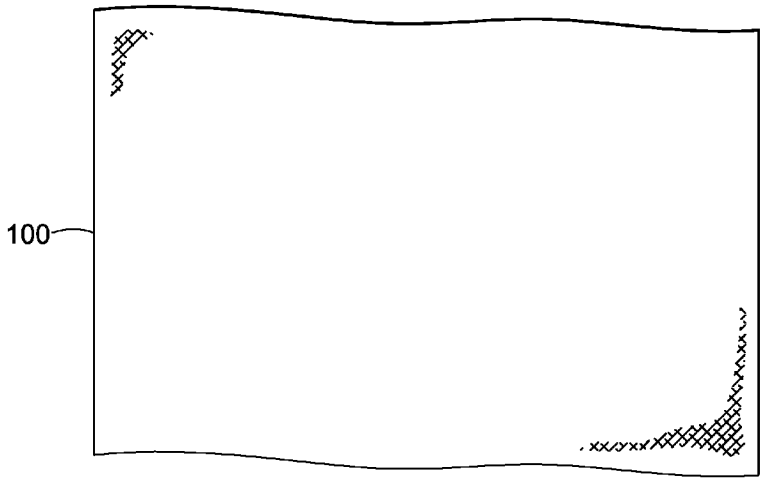
FIG. 1 depicts a front view of a three layer twill weave fabric, in accordance with an embodiment of the technology.

The subject matter of select embodiments of the present invention is described with specificity herein to meet statutory requirements. But the description itself is not intended to define what is regarded as the invention, which is what the claims do. The claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described. It should be understood that throughout the drawings, corresponding reference numerals indicate like or corresponding parts and features.

The invention is not limited to the particular embodiments described and as such may vary. It is also to be understood that the terminology used herein is for the purpose of describing particular embodiments only, and is not intended to be limiting, since the scope of the present invention will be limited only by the appended claims.

Unless otherwise noted, the drawings of the present invention are not necessarily drawn to scale. They demonstrate the basic relationship of the constituent parts, but not necessarily their respective sizes.

Examples of the present invention are directed to an article or flag for use on or around golf courses and a method of manufacturing the same. The article generally comprises a single piece of fabric made of a three layer twill weave. The fabric is woven such that strands of each side of the fabric comprise visible horizontal strands while the vertical strands are not visible. The non-visible vertical strands separate the horizontal strands and are a color that is darker than the horizontal strands. The fabric includes a first side having a first image printed thereon and a second side having a second image printed thereon. The images are sublimated onto the article using an ultraviolet resistant dye.

Examples of the present invention are also directed to methods of producing a double-sided sublimated article. The single fabric, described above, is inserted between a sheet having two images printed thereon. The two images are simultaneously applied to each side of the fabric. Once printed, each side of the fabric includes the images, both being in a correct orientation (i.e., not mirror images of one another).

By way of background, typical sublimation processes do not utilize ultraviolet resistant dyes to simultaneously print images on two sides of a double-sided article in a correct orientation. The present invention provides methods to sublimate both sides of an article at the same time where both sides of the article include an image in a correct orientation. Correct orientation, as used herein, refers generally to an image that is displayed upright in an orientation whereby the image is properly viewed. In other words, an image in the correct orientation is upright and not a mirror image. Typical sublimated articles include an image on only one side with the mirror image bleeding through to the opposite side of the article. Alternatively, if a flag contains an image on both sides it is (1) not images on each side with the correct orientation but, rather, simply an image on one side with the other side being a mirror image of the first which has bled through the fabric; (2) not both sides of the same fabric but, rather, two images sublimated onto two separate pieces of fabric and sewn together, back to back, with or without a separate piece of fabric to block the light and prevent the image on one side from being visible from the opposite side; and (3) not included on an article having a single fabric woven with three layers to block images from each side from bleeding through to the other side where the two sides are sublimated at the same time.

The present technology provided is an article made of a three thread twill weaving pattern having two sides where each side is sublimated at the same time and each side includes the exact same image in a correct orientation without ink from the image on the opposite side bleeding through. FIG. 1 provides a front perspective view of the three thread twill weaving fabric 100. As is illustrated, the fabric 100 is simply a piece of fabric with two sides (i.e., a front side and a back side) measuring approximately 1 mm thick. In embodiments, the fabric 100 is 100% polyester. In alternate embodiments, the flag may comprise two different images printed on each side without any bleed through from either side.

Figure 2:
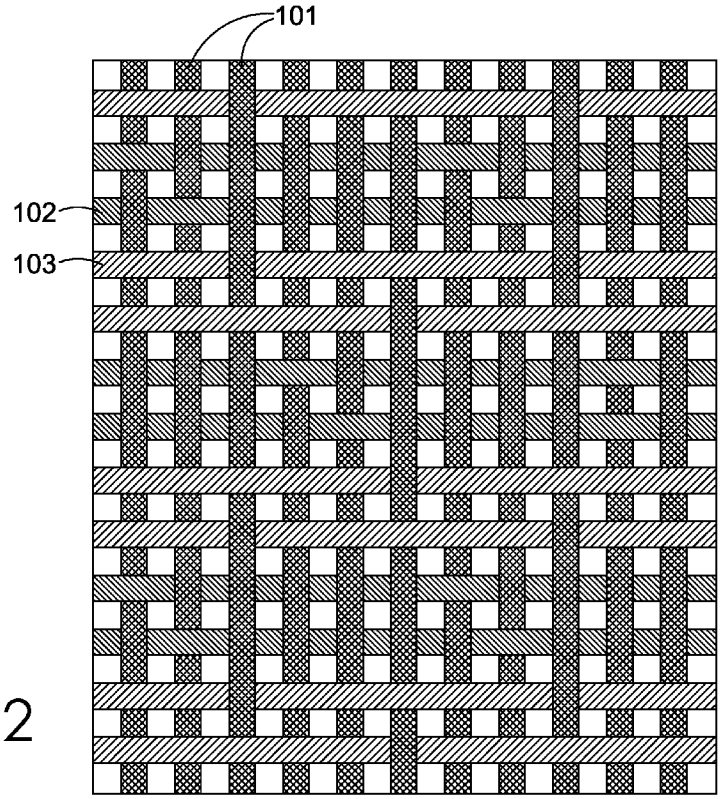
FIG. 2 depicts a front view of an exemplary weave to produce the three layer twill fabric, in accordance with an embodiment of the technology.

FIG. 2 provides a front plan view of a weaving pattern of the fabric 100. As is illustrated, the fabric 100 includes at least two threads: a vertical thread 101 and a horizontal thread (shown by exemplary threads 102 and 103). The horizontal threads 102 and 103 are visible on each side of the article while the vertical threads 101 are not visible. The horizontal threads 102 and 103 are weaved in such a way that a first horizontal thread (such as horizontal thread 102) is visible on a first side of the fabric 100 while a second horizontal thread (such as horizontal thread 103) is visible on a second side of the fabric 100. Meanwhile, the vertical thread 101 is woven with the horizontal threads 102 and 103 such that it is (1) not visible and (2) acts as a barrier between the two sides of the fabric 100.

In embodiments, the vertical thread 101 is a black color to provide a barrier between the horizontal threads 102 and 103. In alternative embodiments, the vertical thread 101 is any color sufficiently dark to provide a barrier between the horizontal threads 102 and 103. Sufficiently dark may comprise any color that is dark enough to prevent light from shining through from one side to the other. In other words, the vertical thread is a color sufficiently dark to eliminate any opaqueness of the horizontal threads. A barrier, as used herein, refers generally to a portion of the fabric 100 (e.g., vertical thread 101) that blocks at least light and ink from permeating through from one side of the fabric 100 to the other side. In preferred embodiments, the vertical thread 101 is a darker thread color to (1) block light so that one image on one side of the fabric 100 cannot be seen from the other side and (2) continue to soak up excess ink such that it doesn't bleed through from one side to the other. Since the vertical thread color is not so dark when using, for example, grey (as opposed to black, for instance), the surface fabric color is not as affected and appears whiter (when the horizontal fabrics are white). The surface fabric color may be any desired color.

As is shown in FIG. 2, a weave pattern is utilized whereby a predetermined number of vertical threads are skipped by the horizontal threads. For example, starting from the left with horizontal thread 102, the horizontal thread 102 goes "under" the first vertical thread encountered, "over" the second vertical thread encountered, "under" the next 5 vertical threads encountered, etc. Horizontal thread 103, in contrast, goes "over" the first two vertical threads encountered, "under" the next vertical thread encountered, and "over" the next 5 vertical threads encountered. The vertical threads are "skipped" in such a way so that the horizontal threads are visible on each side of the fabric but the vertical thread is not visible. Other weaving patterns may be used to accomplish the same visibility of threads.

Figure 3:
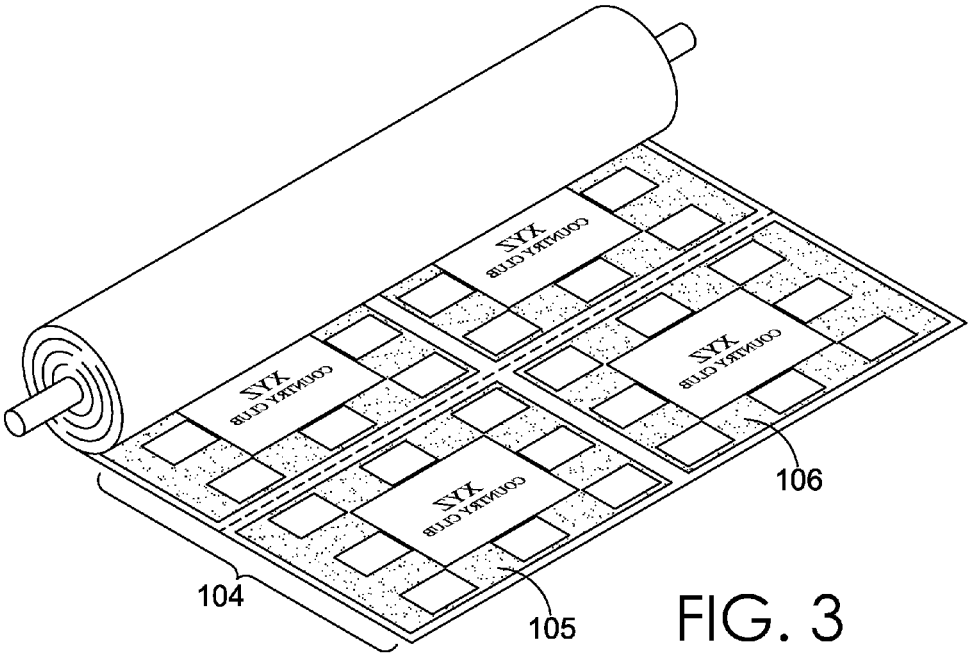
FIG. 3 depicts a top perspective view of a printed sheet, in accordance with an embodiment of the technology.

Turning now to FIG. 3, a top perspective view of a printed sheet 104 is provided. Wide rolls of paper are loaded and fed through a printer where images are printed onto printer paper (e.g., printed sheet 104) using heat transfer dye sublimation ink. An exemplary ink is ISWL7 ink manufactured by Sensient Technologies. Any ultraviolet resistant ink appropriate for sublimation may be used. Once printed, the images appear as provided in FIG. 3 whereby a printed sheet 104 includes a first image 105 and a second image 106. The first image 105 and the second image 106 are identical. The output on the printed sheet 104 is a mirror image so that when applied to the fabric 100, the image will be in the correct orientation (not the mirror image).

Figure 4:
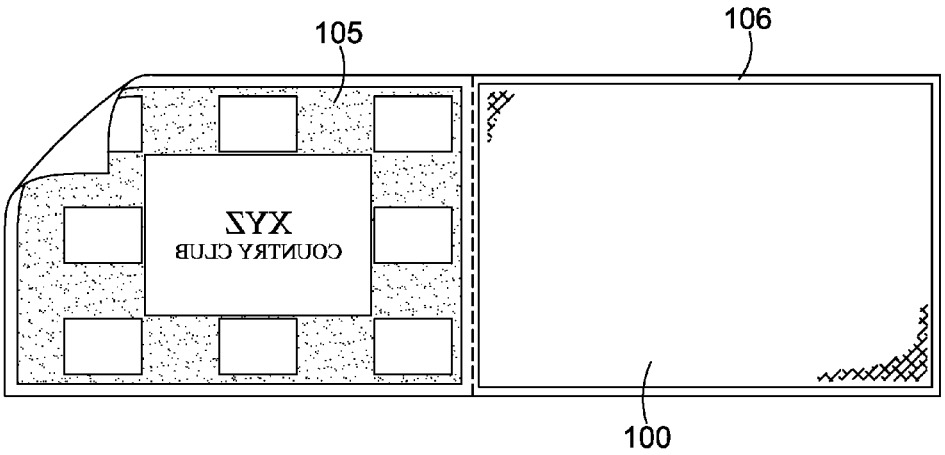
FIG. 4 depicts a front perspective view of a three layer twill weave fabric inserted between two images of a printed sheet, in accordance with an embodiment of the technology.

When printing is complete, each individual print out for the golf flag is cut out as shown in FIG. 4. FIG. 4 illustrates an individual print out from FIG. 3 cut on the perforated line of FIG. 3. Once the printed sheet 104 is cut, the printed sheet 104 is folded in half so the images mirror one another (e.g., along the perforated line in FIG. 4). At this point, while still a single printed sheet 104, the printed sheet may be referred to as a first printed sheet (the side with the first image printed thereon) and the second printed sheet (the side with the second image printed thereon) for clarity.

A piece of precut fabric is then inserted into the print out. For instance, FIG. 4 illustrates the fabric 100 being inserted between the first image 105 and the second image 106. As the fabric 100 is placed over the second image 106, the image itself is not visible in the illustration but the reference numeral is provided to indicate that the printed sheet of the second image 106 is underneath the fabric 100.

The "flag sandwich" is then fed into a heat press and exposed to heat for a predetermined amount of time that allows the ink to sublimate and be absorbed by the fabric. Adhesive on the printed sheet 104 is activated causing a slight bond between the printed sheet 104 and the fabric 100. An exemplary amount of time may be 30-40 seconds at 400 degrees.

The heat press utilized in the present invention is a rotary heat press having a drum diameter of 24" and being 72" long. These are merely exemplary sizes and any suitable heat press may be used. The heat press with a drum diameter of 24" is useful for printing larger golf flags. For example, the two sided fabric is approximately 1 mm thick so, when it lies flat, the paper on the bottom (next to the drum) is the same length as the fabric and the paper on the top. However, when the "flag sandwich" goes around the drum (i.e., a curve) the paper on the bottom, next to the drum, travels 25.5 inches but the paper on top is trying to travel a greater distance because the diameter of the drum is increased by 1 mm due to the thickness of the fabric. This distance increases proportionately as the size of the drum decreases. The further the top paper has to travel relative to the bottom paper, the more problems are created. Two likely outcomes are: (1) the paper closest to the drum can pinch causing gas lines; or (2) the top paper slides on the fabric causing a blurry image.

In particular, the top paper on the 24" drum has to travel 0.04 inches further than the bottom paper for a traditional golf flag (i.e., 3'×5' in this example). For a 5 foot traditional flag, over the length of the flag this difference is 0.10 inches. This added distance is what contributes to making it more challenging to produce larger two-sided flags versus shorter golf flags. Most rotary presses have a drum diameter of 12" or smaller. In the case of a 12" drum, the difference in distance between the top and bottom sheet for a golf flag and a 5 foot flag are 0.08" and 0.20", respectively.

A flatbed press is not a good solution to this issue as the flatbed press presses down against the fabric, which heats up the surface of the fabric. However, since heat rises, there is a significant difference between the top and bottom of the fabric. This temperature difference will produce different results on each side. Additionally, the size of the press limits the size of the flag. While you can get larger presses, as their size increases so does the ability to maintain constant temperature on every square inch of the platen. This is one of the most significant advantages of a rotary press (i.e., temperature consistency).

Figure 5:
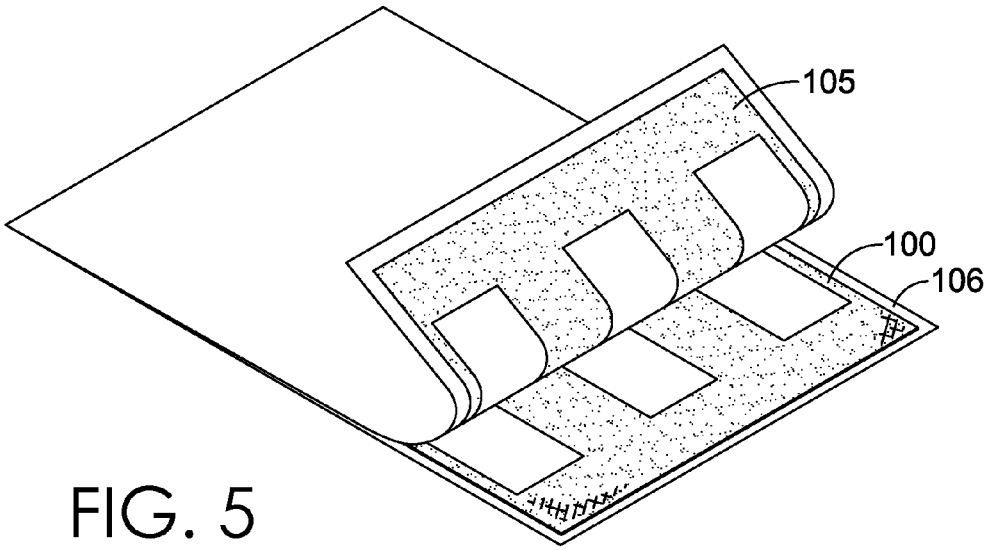
FIG. 5 depicts a top perspective view of a printed fabric between two images of a printed sheet, in accordance with an embodiment of the technology.

As the product exits, it begins to cool and exits the sublimation process. After it has cooled completely, the fabric 100 is separated from the printed paper 104. This separation is illustrated in FIG. 5 whereby the printed sheet side with the first image 105 is lifted from the fabric 100. The fabric 100 is then removed from the printed sheet with the second image 106.

Figure 6:
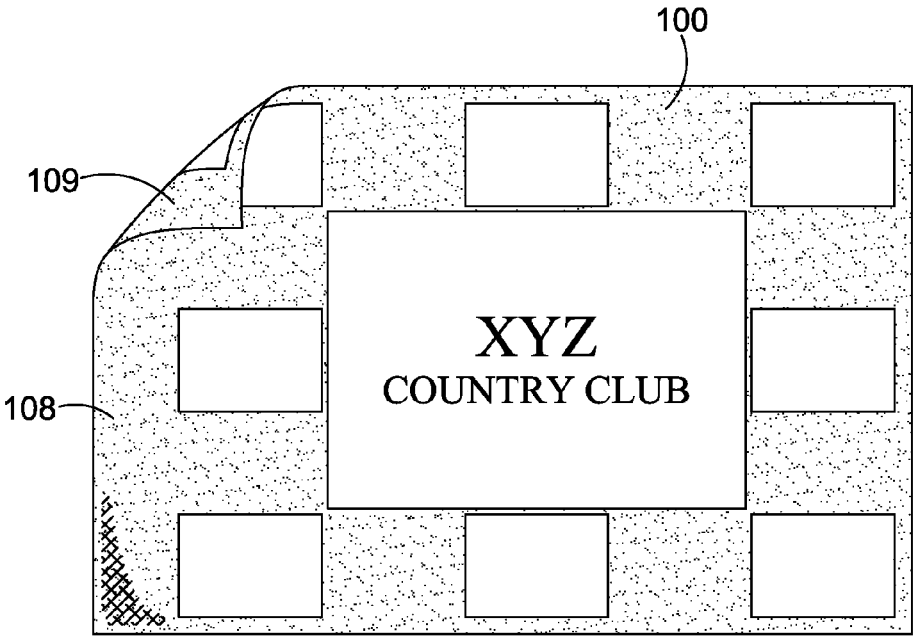
FIG. 6 depicts a front perspective view of a double-sided dye sublimated fabric, in accordance with an embodiment of the technology.
Figure 7:
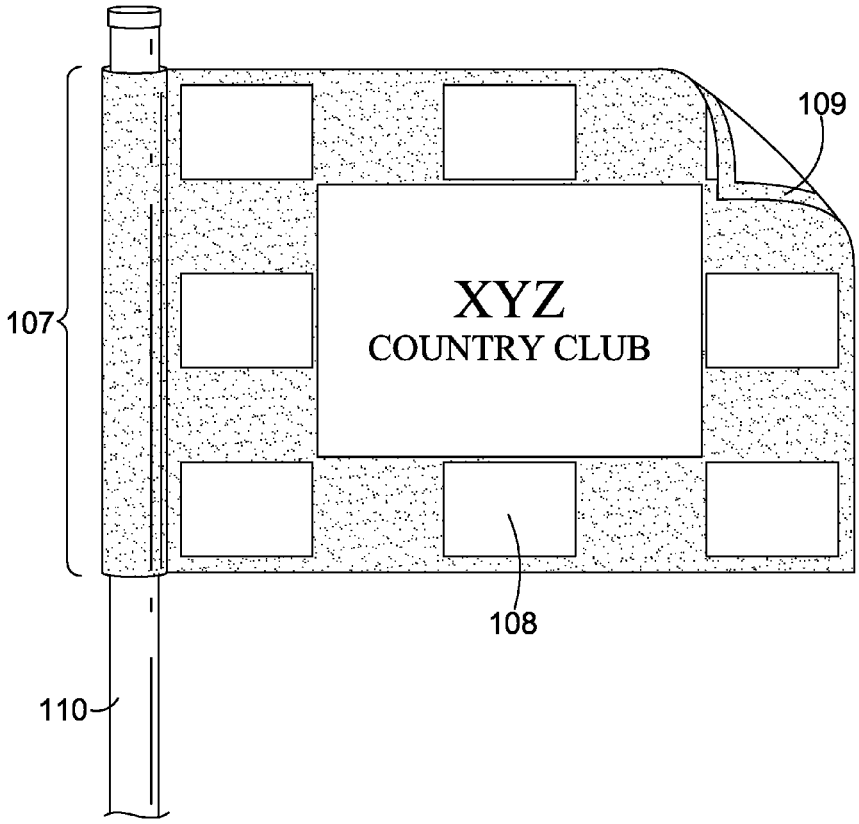
FIG. 7 depicts a front perspective view of a double-sided dye sublimated golf flag, in accordance with an embodiment of the technology.
Figure 8:
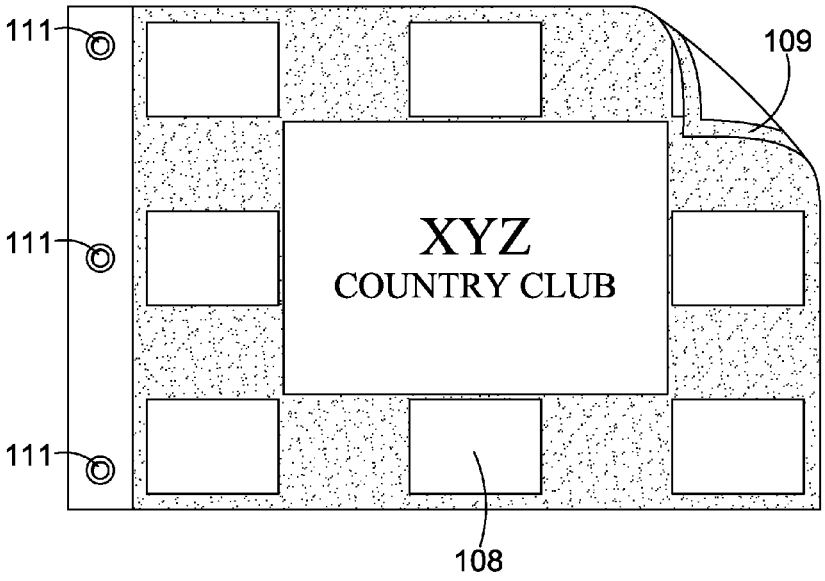
FIG. 8 depicts a front perspective view of a double-sided dye sublimated golf flag, in accordance with an embodiment of the technology.

The final printed fabric 100 is illustrated in FIG. 6 where the fabric 100 includes a first side 108 printed with the first image and a second side 109 printed with the second image. The fabric is then ready to be sewn to produce a flag, or any other suitable article. In embodiments, the flag is a tube flag, as shown in FIG. 7. The flag of FIG. 7 illustrates the first side 108 and the second side 109. Additionally, a hollow cavity 107 is depicted as housing a tube 110 insert. Alternatively, the flag may be a grommet-type flag as provided in FIG. 8 whereby the flag includes the first side 108, the second side 109, and one or more grommets 111.

Any number of sewing machines may be used to produce the flags. In the case of a tubed golf flag, a two needle sewing machine, a cylinder bed sewing machine, and a bar tack machine are used. In the case of a flag with flag binding and grommets, a two needle sewing machine, single needle sewing machine, and bar tack machine are used. A setting machine is used to set the grommets.

Figure 9:
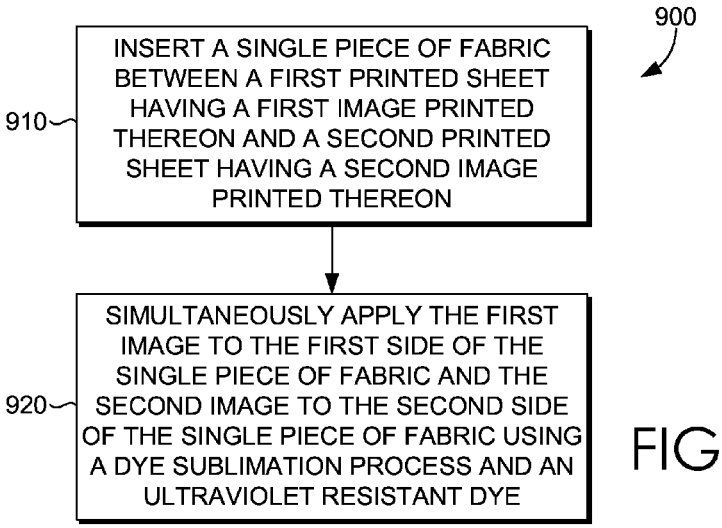
FIG. 9 depicts a flow diagram of a method for sublimating a double-sided golf flag, in accordance with an embodiment of the technology.

Turning now to FIG. 9, a first method 900 of sublimating a double-sided golf flag is provided. Initially, at block 910, a single piece of fabric is inserted between a first printed sheet having a first image printed thereon and a second printed sheet having a second image printed thereon. At block 920, the first image is applied to the first side of the single piece of fabric while the second image is simultaneously applied to the second side of the single piece of fabric using a dye sublimation process and ultraviolet resistant dye.

Figure 10:
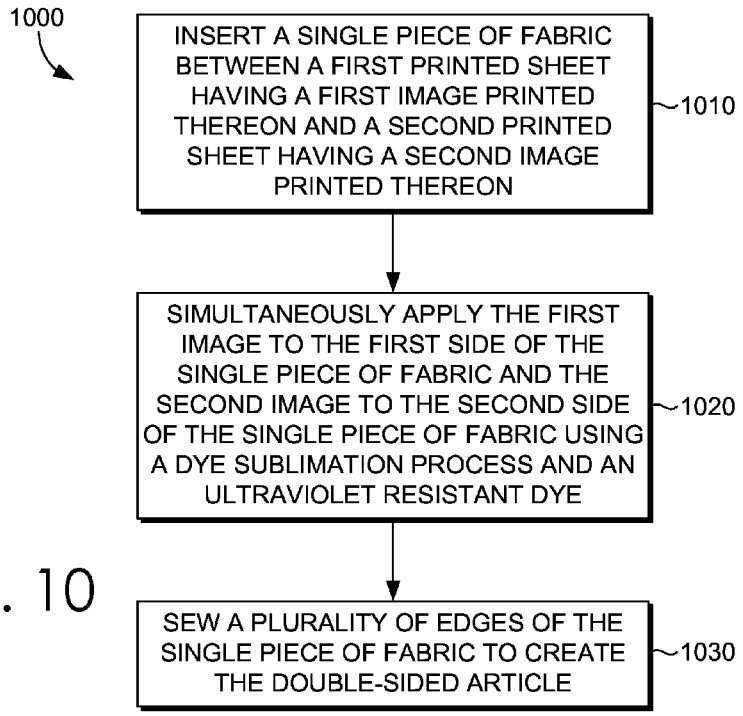
FIG. 10 depicts a flow diagram of a method for sublimating an article, in accordance with an embodiment of the technology.

FIG. 10 provides a second method 1000 of sublimating a double-sided article. Initially, at block 1010, a single piece of fabric is inserted between a first printed sheet having a first image printed thereon and a second printed sheet having a second image printed thereon. At block 1020, the first image is applied to the first side of the single piece of fabric while the second image is simultaneously applied to the second side of the single piece of fabric using a dye sublimation process and an ultraviolet resistant dye. At block 1030, a plurality of edges of the single piece of fabric are sewn to create the double sided article.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A golf flag sublimated with ultraviolet resistant dye comprising:

a single piece of fabric made of a three layer twill weaving, wherein the single piece of fabric comprises:

(1) a first layer comprising a first side having a first image printed thereon utilizing the ultraviolet resistant dye; and (2) a second layer comprising a second side having a second image printed thereon utilizing the ultraviolet resistant dye, wherein the second image is identical to the first image; and wherein each of the first layer and the second layer comprise a plurality of visible horizontal strands in a first color that is separated by a third layer, wherein the third layer comprises at least one vertical strand in a second color.

2. The golf flag of claim 1, wherein the second color is black.

3. The golf flag of claim 1, wherein the second color is darker than the first color such that the vertical strand acts to block ink from the first side from permeating to the second side.

4. The golf flag of claim 1, wherein the first image and the second image are identical and orientated such that each of the first image and the second image are printed in a correct orientation.

5. The golf flag of claim 1, wherein the golf flag further comprises one or more grommets.

6. The golf flag of claim 1, wherein the single piece of fabric is polyester.

7. A method of sublimating a double-sided golf flag, the method comprising:

inserting a single piece of fabric between a first printed sheet having a first image printed thereon and a second printed sheet having a second image printed thereon, wherein the single piece of fabric comprises a first layer having a first side and a second layer having a second side, wherein the first layer and the second layer comprise a plurality of visible horizontal strands in a first color that is separated by a third layer that comprises at least one vertical strand in a second color; and simultaneously applying the first image to the first side of the single piece of fabric and the second image to the second side of the single piece of fabric using a dye sublimation process and an ultraviolet resistant dye, wherein the first image on the first side of the single piece of fabric is identical to the second image on the second side of the single piece of fabric and each of the first image and the second image are applied in a correct orientation.

8. The method of claim 7, wherein the correct orientation is a display of an image that is not a mirror image.

9. The method of claim 7, wherein the second color is black.

10. The method of claim 7, wherein the second color is darker than the first color such that the vertical strand blocks light from the first side from permeating to the second side.

11. The method of claim 10, wherein the single piece of fabric is polyester.

12. The method of claim 7, further comprising sewing the single piece of fabric into the double-sided golf flag.

13. The method of claim 12, further comprising inserted one or more grommets into the golf flag.

14. A method of sublimating a double-sided article, the method comprising:

inserting a single piece of fabric between a first printed sheet having a first image printed thereon and a second printed sheet having a second image printed thereon, wherein the single piece of fabric comprises a first layer having a first side and a second layer having a second side, wherein the first layer and the second layer comprise a plurality of visible horizontal strands in a first color that is separated by a third layer that comprises at least one vertical strand in a second color;

simultaneously applying the first image to the first side of the single piece of fabric and the second image to the second side of the single piece of fabric using a dye sublimation process and an ultraviolet resistant dye, wherein the first image on the first side of the single piece of fabric is identical to the second image on the second side of the single piece of fabric and each of the first image and the second image are applied in a correct orientation; and sewing a plurality of edges of the single piece of fabric to create the double-sided article.

15. The method of claim 14, wherein the correct orientation is a display of an image that is not a mirror image.

16. The method of claim 14, wherein the second color is black.

17. The method of claim 14, wherein the second color is darker than the first color such that the vertical strand blocks light from the first side from permeating to the second side.

18. The method of claim 14, wherein the article is an outdoor flag.

19. The method of claim 14, wherein the single piece of fabric is polyester.

* * * * *